US010890299B2

(12) United States Patent
Ye et al.

(10) Patent No.: US 10,890,299 B2
(45) Date of Patent: Jan. 12, 2021

(54) LED FILAMENT LAMP

(71) Applicant: Zhejiang Z-Light Optoelectronics Co., Ltd., ZheJiang (CN)

(72) Inventors: Yiping Ye, ZheJiang (CN); Jianwu Xue, ZheJiang (CN); Guocai Chen, ZheJiang (CN)

(73) Assignee: Zhejiang Z-Light Optoelectronics Co., Ltd., Hangzhou (CN)

( * ) Notice: Subject to any disclaimer, the term of this patent is extended or adjusted under 35 U.S.C. 154(b) by 36 days.

(21) Appl. No.: 16/232,325

(22) Filed: Dec. 26, 2018

(65) Prior Publication Data

US 2019/0195435 A1 Jun. 27, 2019

(30) Foreign Application Priority Data

Dec. 26, 2017 (CN) ..... 2017 1 1433384

(51) Int. Cl.
*F21K 9/235* (2016.01)
*F21V 3/06* (2018.01)
(Continued)

(52) U.S. Cl.
CPC ..... *F21K 9/235* (2016.08); *F21K 9/232* (2016.08); *F21K 9/238* (2016.08); *F21V 3/061* (2018.02);
(Continued)

(58) Field of Classification Search
CPC ..... F21K 9/232
See application file for complete search history.

(56) References Cited

U.S. PATENT DOCUMENTS

2012/0025706 A1* 2/2012 Wang ..... F21V 29/78 315/35
2012/0049751 A1 3/2012 Wang
(Continued)

FOREIGN PATENT DOCUMENTS

CN 201416789 Y 3/2010
CN 204284982 U 4/2015
(Continued)

*Primary Examiner* — Diane I Lee
*Assistant Examiner* — Zachary J Snyder
(74) *Attorney, Agent, or Firm* — Muncy, Geissler, Olds & Lowe, P.C.

(57) ABSTRACT

The present invention belongs to the technical field of lighting devices, in particular to an LED filament lamp. The LED filament lamp comprises a transparent hood with an opening at the lower end, and a lamp cap connected to the transparent hood, and a light emitting source is arranged in the transparent hood. The LED filament lamp also comprises a support base; the support base is arranged in a space enclosed by the transparent hood and the lamp cap; the light emitting source is fixed on the support base, and the lower end of the light emitting source is connected with the lamp cap through a current limiting resistor. The light emitting source comprises a single strip-shaped substrate, and a plurality of LED wafers; the two ends of the strip-shaped substrate are conductive electrical connecting ends; the plurality of LED wafers are connected in turn and arranged on the strip-shaped substrate at an interval to form a strip-shaped LED wafer set; a rectifying unit electrically connected with the strip-shaped LED wafer set is arranged at each one of the two ends of the strip-shaped LED wafer set; and each one of the rectifying units is fixed on the strip-shaped substrate and is electrically connected with each corresponding one of the electrical connecting ends. The present invention provides an LED filament lamp which is
(Continued)

conveniently assembled and can be directly connected with an alternating current.

10 Claims, 6 Drawing Sheets

(51) Int. Cl.

| | |
|---|---|
| ***F21V 19/00*** | (2006.01) |
| ***F21V 23/06*** | (2006.01) |
| ***F21V 17/06*** | (2006.01) |
| ***F21K 9/232*** | (2016.01) |
| ***F21K 9/238*** | (2016.01) |
| ***F21V 23/02*** | (2006.01) |
| ***F21Y 115/10*** | (2016.01) |
| ***F21Y 103/10*** | (2016.01) |

(52) U.S. Cl.
CPC ..... *F21V 17/06* (2013.01); *F21V 19/003* (2013.01); *F21V 23/02* (2013.01); *F21V 23/06* (2013.01); *F21Y 2103/10* (2016.08); *F21Y 2115/10* (2016.08)

(56) References Cited

U.S. PATENT DOCUMENTS

| | | | | |
|---|---|---|---|---|
| 2012/0051069 | A1* | 3/2012 | Lim | F21V 3/02 362/373 |
| 2012/0217862 | A1* | 8/2012 | Matsuda | F21K 9/232 313/46 |
| 2016/0363267 | A1* | 12/2016 | Jiang | F21V 29/70 |
| 2017/0347423 | A1* | 11/2017 | Xiong | F21K 9/278 |
| 2018/0347802 | A1* | 12/2018 | Fu | F21K 9/232 |

FOREIGN PATENT DOCUMENTS

| | | | |
|---|---|---|---|
| CN | 102330893 | A | 1/2018 |
| CN | 108087734 | A | 5/2018 |
| CN | 107448790 | A | 12/2018 |

* cited by examiner

LED FILAMENT LAMP

CROSS-REFERENCE TO RELATED APPLICATION

The present application relies on, for priority, China Patent Application number 201711433384.6 entitled "LED Filament Lamp", filed on Dec. 26, 2017, which is also herein incorporated by reference in its entirety.

TECHNICAL FIELD

The present invention relates to the technical field of lighting devices, in particular to an LED filament lamp.

BACKGROUND OF THE INVENTION

LED is an abbreviation of light emitting diode. The basic structure of an LED is an electroluminescent semiconductor chip. The chip is fixed at a bracket with silver glue or white glue; then, the chip and a circuit board are connected using a silver wire or a gold wire; and epoxy resin is applied to seal all around to play the role of protecting the internal core wire; and finally, a housing is installed. Therefore, LED lamps have high vibration resistance. As a novel lighting source, energy-saving LED lamps are popular among the masses and have won great support from the country by virtue of their obvious features such as energy conservation, sanitation, environmental friendliness and long service life.

For a traditional LED lamp, for example, the Chinese patent CN205424483U discloses the following technical contents: a simple LED filament lamp, comprises an LED filament, a bulb shell and an electrical connector, and further comprises a circuit board, a driving circuit and sealant; the LED filament is arranged on one side of the circuit board; the driving circuit is arranged on the other side or two sides of the circuit board; the driving circuit has an output terminal electrically connected with the LED filament, and an input terminal electrically connected with the electrical connector; and the sealant is applied to mutually connect, fix, and seal the circuit board, the electrical connector, and the bulb shell.

At the same time, for an existing LED filament, a strip-shaped substrate is usually fixed with a plurality of LED wafers, and the plurality of LED wafers are connected in series or in parallel using metal wires. The LED filament light-emitting device using such encapsulation approach can use the direct current only, so that when the LED filament light-emitting device is used at an application terminal, conversion from the alternating current to the direct current is needed.

The Chinese patent CN106900116A discloses the following technical contents: An AC(AC is an abbreviation of alternating current, hereinafter inclusive) driving LED light source, comprises a first LED unit, a second LED unit, a third LED unit, a fourth LED unit and a fifth LED unit; the first LED unit, the second LED unit, the third LED unit and the fourth LED unit are connected with one another to form a full-bridge rectifying circuit; an AC power supply is connected between one pair of opposite angles of the full-bridge rectifying unit, and the fifth LED unit is connected between the other pair of opposite angles of the full-bridge rectifying unit; in a positive period of the AC power supply, the first LED unit, the fifth LED unit and the fourth LED unit are switched on; in a negative period of the AC power supply, the second LED unit, the fifth LED unit and the third LED unit are switched on, wherein one or more of the first LED unit, the second unit, the third LED unit, the fourth LED unit and the fifth LED unit is (are) provided with a constant-current IC chip such that a constant current is generated in the positive period and negative period of the AC power supply, and an after-glow fluorescent layer is coated on the surface of each one of the first LED unit, the second unit, the third LED unit and the fourth LED unit to eliminate strobe flash.

Products manufactured according to the above two technical solutions are complicated in structure; during the production process, sealant is needed to fix all structural components, and it fails to realize practical connection to the AC power supply. Therefore, the bulb production process is very complicated. At the same time, traditional LED lamps all have a circuit board and a driving circuit, which occupy a very large space in bulbs and cause an increase in the production cost.

BRIEF SUMMARY OF THE INVENTION

The technical problem to be solved by the present invention is to provide an LED filament lamp which is conveniently assembled and can be directly connected to an AC power supply. For this reason, the present invention employs the following technical scheme:

An LED filament lamp includes a transparent hood with an opening at the lower end and a lamp cap connected to the lower end of the transparent hood, and a light emitting source is arranged in the transparent hood.

The LED filament lamp also includes:

a support base, wherein the support base is arranged in a space enclosed by the transparent hood and the lamp cap;

the light emitting source is fixed at the support base, the lower end of the light emitting source is connected with the lamp cap through a current limiting resistor, and the light emitting source includes a single strip-shaped substrate and a plurality of LED wafers;

wherein two ends of the strip-shaped substrate are conductive electrical connecting ends;

wherein the plurality of LED wafers are connected in turn and arranged on the strip-shaped substrate at an interval to form a strip-shaped LED wafer set, a rectifying unit electrically connected with the strip-shaped LED wafer set is arranged at each one of the two ends of the strip-shaped LED wafer set, each one of the rectifying units is fixed on the strip-shaped substrate and is connected with each corresponding one of the electrical connecting ends, each one of the electrical connecting ends is capable of being directly connected with an alternating current power supply and energizes the strip-shaped LED wafer set such that the LED wafers emit light;

wherein when the lamp cap is connected with an external grid circuit, a current path is respectively formed between the lamp cap and the current limiting resistor and between the lamp cap and the light emitting source to energize the light emitting source, so that the light emitting source emits light.

The support base is made of an insulating material and plays the role of fixing the lighting emitting source. The above-mentioned structure is an improvement made on the basis of the traditional LED bulb structure. The two ends of an LED device can be directly connected to an AC power supply, so that a driving power supply arranged in the traditional LED bulb can be removed. At the same time, the production procedure of vacuuming the transparent hood and then filling in inertia gas is not needed, and the bulb can light up only with air.

On the basis of the above technical scheme, the present invention may also employ the following further technical scheme:

the transparent hood is made of glass, and the transparent hood and the lamp cap are fixed with adhesive. Of course, the step of applying the adhesive is not necessary because the adhesive merely plays the role of fixing the transparent hood and the lamp cap more firmly.

The transparent hood is made of a plastic material; the transparent hood is provided with external screw threads at the opening of the lower end; the lamp cap is provided with internal screw threads; the transparent hood and the lamp cap are in a threaded connection; and a groove is formed at the external screw threads of the transparent hood. The transparent hood is simply connected with the lamp cap through screw threads, so that the filament lamp is simply dismantled to replace parts, and the operation is fast and convenient.

The support base includes a seat and a fixed boss arranged on the seat; the fixed boss is formed with a fixing hole which runs through the seat; the lower end of the seat is provided with external screw threads; the lamp cap is provided with internal screw threads; and, the seat and the lamp cap are in a threaded connection.

The support base includes a seat and a fixed boss arranged on the seat; the fixed boss is formed with a fixing hole which runs through the seat; a clamping block is arranged on a lower lateral wall of the seat; and the clamping block is clamped with and fixed in the groove of the transparent hood. The seat is clamped and fixed with the transparent hood through the clamping block, and then together with the transparent hood, is connected and fixed with the lamp cap.

The upper end of the light emitting source is connected with the support base through a support member, and the lower end of the support member extends out of the support base and is connected with the lamp cap. When one light emitting source is configured, the support member is a long conductive wire; the conductive wire has a bent portion at the upper end; the bent portion is welded with the upper end of the light emitting source; a connecting portion with a relatively small diameter is arranged at the lower end of the conductive wire; the connecting portion passes through the fixing hole of the support base and is connected with the support base in a through-hole fastening way. Where, the specific through-hole fastening way is specifically as follows: a winding rod is arranged at a lower lateral side of the fixing hole of the support base, and after the lower end of the connecting portion passes through the fixing hole, the excessive part is coiled and fixed on the winding rod. The bent portion is set to facilitate welding, or to strengthen the fixation stability of the light emitting source.

The upper end of the light emitting source is connected with the support base through a support member, and the lower end of the support member extends out of the support base and is connected with the lamp cap. When more than one light emitting source is provided, the support member is a support column; the support column includes a support stand and support pillars arranged on the support stand; the support stand is formed with two through-holes, a run-through positioning hole is formed on the top end of each one of the support pillars, and the light emitting sources are fixed on the support column through metal wires.

Each one of the individual light emitting sources is welded with a first metal wire at the top end and a second metal wire at the bottom end; each one of the first metal wires is inserted in and fixed at each corresponding one of the positioning holes and all first metal wires are converged and connected in the positioning holes; the second metal wires pass through the through-holes of the support stand and then are inserted into and fixed at the fixing hole of the support base; the lower end of at least one of the second metal wires is connected with the lamp cap and the lower end of at least one of the second metal wires is connected with the current limiting resistor.

The upper end of the current limiting resistor is welded with the lower end of the light emitting source through a third metal wire which passes through the fixing hole of the support base; the third metal wire is provided with a bend at a position close to the light emitting source; and the current limiting resistor functions as a fuse.

The lower end of the current limiting resistor is connected with the lamp cap through a lamp cap fixture, and the lamp cap fixture includes a round base and an support pillar arranged on the round base. A hole where the support pillar is inserted is formed in the bottom center of the lamp cap; the lower end of the current limiting resistor penetrates out of the hole and then the lamp cap fixture is inserted to press and fix the lower end of the current limiting resistor in the hole of the lamp cap.

The rectifying units include a first rectifying unit and a second rectifying unit which are arranged on one side of the strip-shaped LED wafer set, and a third rectifying unit and a fourth rectifying unit which are arranged on the other side of the strip-shaped LED wafer set, the four rectifying units and the strip-shaped LED wafer set communicate with one another to form a rectifying circuit. The four rectifying units may be transversely or longitudinally arranged two by two in parallel according to the actual layout demands of the strip-shaped substrate.

A first conductor and a second conductor are respectively arranged on two lateral sides of the face, on which the LED wafers are fixed, of the strip-shaped substrate; the first conductor is connected with an output terminal of the first rectifying unit, an input terminal of the strip-shaped LED wafer set, and an output terminal of the fourth rectifying unit, and the second conductor is connected with an input terminal of the second rectifying unit, an output terminal of the strip-shaped LED wafer set, and an input terminal of the third rectifying unit. In the state of connection to an external AC power supply, two switched-on circuits are obtained, which means that the current passes through the first rectifying unit, the strip-shaped LED wafer set and the third rectifying unit in turn, or the current passes through the fourth rectifying unit, the strip-shaped LED wafer set and the second rectifying unit in turn.

The first rectifying unit and the second rectifying unit are oppositely arranged; the third rectifying unit and the fourth rectifying unit are oppositely arranged; each one of the rectifying units includes at least one rectifying diode or an LED wafer, thus forming a rectifying bridge circuit. The number of the rectifying diode or LED wafer in each one of the rectifying units can be set according to actual demands. Of course, the configuration of a single rectifying diode or a single LED wafer can conduct the rectifying function and minimize the cost.

When each one of the rectifying units is internally provided with a plurality of rectifying diodes or LED wafers, the rectifying diodes or LED wafers in each one of the rectifying units are arranged toward the same direction.

The rectifying diodes are high-voltage-withstanding silicon rectifying diodes with higher safety and a longer service life.

The strip-shaped LED wafer set and the rectifying units all are arranged on the same side of the strip-shaped substrate, which helps simplify the production process. Of course, when the strip-shaped LED wafer set and the rectifying units may also be arranged on different sides of the strip-shaped substrate, the two ends of the strip-shaped substrate can also be directly connected with the AC power supply, but the production and wires are relatively complicated.

The LED wafers in the strip-shaped wafer set are connected toward the same direction.

The strip-shaped substrate may be a transparent or non-transparent strip-shaped substrate, and glue mixed with fluorescent powder is capable of being applied to the two sides of the strip-shaped substrate.

The present invention has the following advantages: the rectifying diodes or LED wafers, in a special design, are configured to form a rectifying circuit, so that the two ends of a single strip-shaped substrate can be directly connected with the AC power supply; the bulb is internally provided with only one electrical apparatus element, namely the current limiting resistor, and the circuit board and the driving circuit are not needed, thus greatly reducing the production cost of the bulb. At the same time, the LED filament lamp of the present invention can be directly connected with the AC power supply, and can be applied to various occasions. The LED filament lamp has high flexibility and a long service life.

Where, transparent hood—1; external screw threads—11; groove—12; lamp cap—2; light emitting source—3; first metal wire—31; second metal wire—32; support base—4; seat—41; fixed boss—42; fixing hole—43; clamping block—44; support member 5; bent portion—51; connecting portion—52; support stand—53; support pillar—54; current limiting resistor—6; third metal wire—61; adhesive—7; lamp cap fixture—8; round seat—81; support pillar—82; strip-shaped substrate—10; first conductor—101; second conductor—102; LED wafer set—20; LED wafer—201; electrical connecting portion—30; first rectifying unit—401; second rectifying unit—402; third rectifying unit—403; fourth rectifying unit—404; rectifying diode—50.

DETAILED DESCRIPTION OF THE INVENTION

The LED filament lamp provided by present invention is described in further detail in conjunction with the attached drawings.

Figure 1:
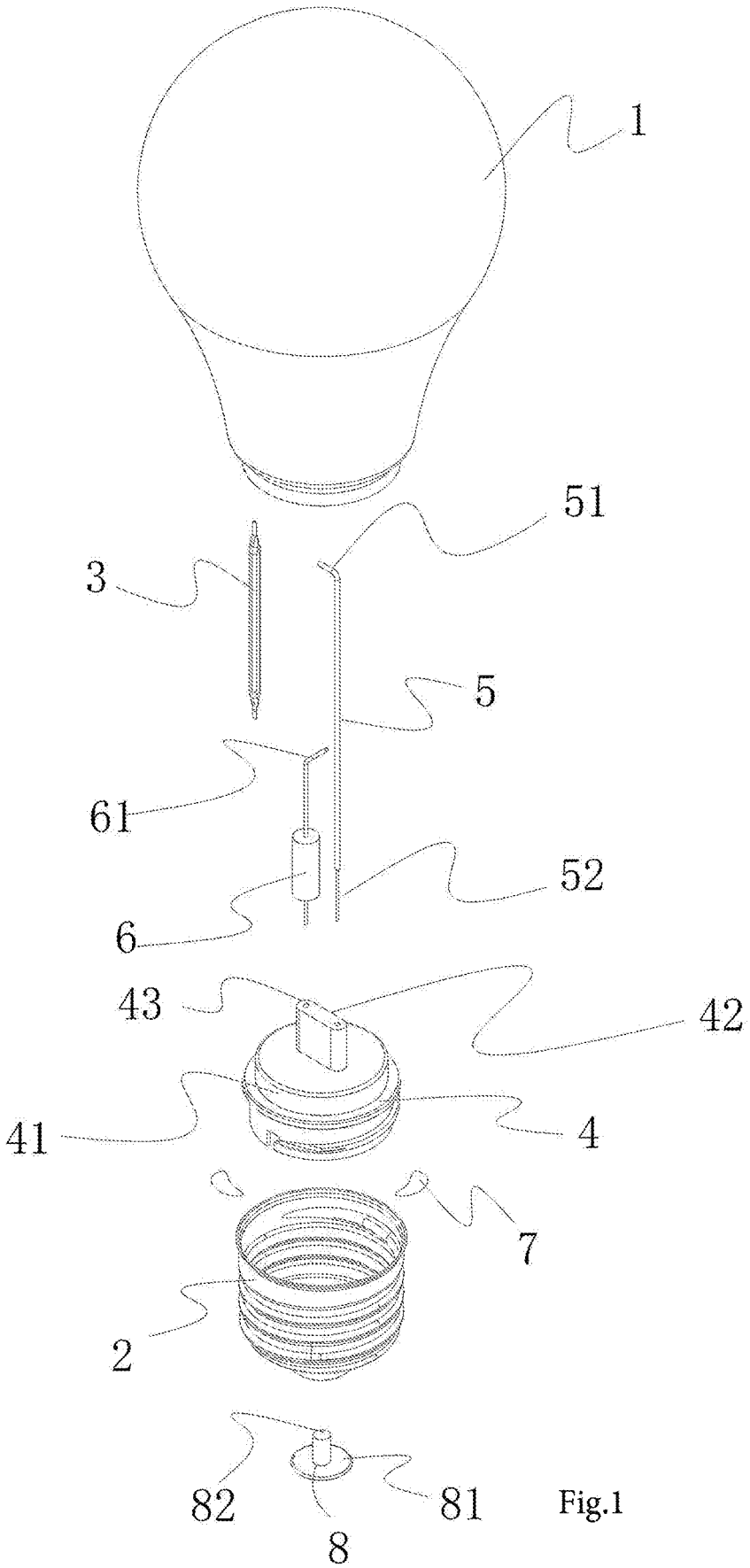
FIG. 1 is an exploded view of embodiment 1 of an LED filament lamp of the present invention.

Embodiment 1 As shown in FIG. 1, an LED filament lamp includes a transparent hood 1 with an opening at the lower end, and a lamp cap 2 connected to the lower end of the transparent hood 1; the transparent hood 1 is made of glass, and the transparent hood 1 and the lamp cap 2 are fixed with adhesive 7.

A light emitting source 3 is arranged in the transparent hood 1; a support base 4 is arranged in a space enclosed by the transparent hood 1 and the lamp cap 2; one end of the light emitting source 3 is connected with the support base 4 through a support member 5; the other end of the light emitting source 3 is connected with the lamp cap 2 through a current limiting resistor 6, and the lower end of the support member 5 extends out of the support base 4 and is connected with the lamp cap 2.

When a bulb is working and under the condition that the lamp cap 2 is connected with an external grid circuit, the lamp cap 2, the current limiting resistor 6, the light emitting source 3 and the support member 5 form a current path to energize the light emitting source 3, so that the light emitting source emits light.

Further, the support base 4 includes a seat 41 and a fixed boss 42 arranged on the seat 41; the fixed boss 42 is formed with a fixing hole 43 which runs through the seat 41; the seat 41 is provided with external screw threads at the lower end; the lamp cap 2 is provided with internal screw threads; and the seat 41 and the lamp cap 2 are in a threaded connection.

In this embodiment, the transparent hood 1 is internally provided with one light emitting source 3. In such circumstances, the support member 5 is a long conductive wire; a bent portion 51 is arranged at the upper end of the conductive wire; and the bent portion 51 is welded with the upper end of the light emitting source 3. A connecting portion 52 with a relatively small diameter is arranged at the lower end of the support member 5; after the connecting portion 52 passes through the fixing hole 43 of the support base 4, the excessive part is coiled and fixed at a rod which is arranged below the support base 4 and on a lateral side of the fixing hole 43.

Further, the upper end of the current limiting resistor 6 is welded with the lower end of the light emitting source 3 through a third metal wire 61 which passes through the fixing hole 43, and the third metal wire 61 is provided with a bend 62 at a position close to the light emitting source 3.

Further, the lower end of the current limiting resistor 6 is connected with the lamp cap 2 through a lamp cap fixture 8, and the lamp cap fixture 8 includes a round seat 81 and an support pillar 82 arranged on the round seat.

Figure 4:
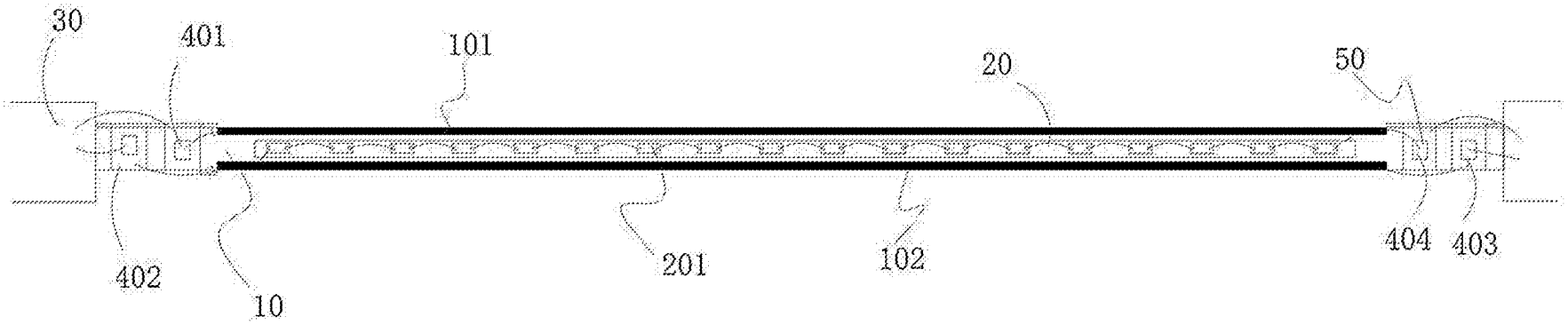
FIG. 4 is a structural view of a light emitting source in embodiment 1 of the LED filament lamp of the present invention.
Figure 6:
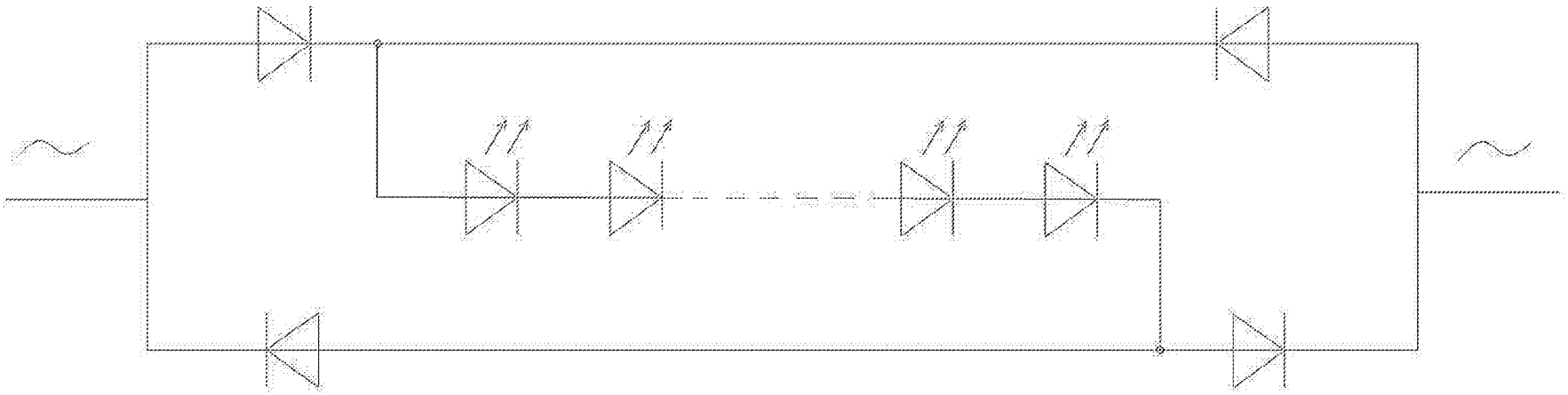
FIG. 6 is a schematic diagram of a circuit of the light emitting source of the LED filament lamp of the present invention.

As shown in FIG. 4 and FIG. 6, an LED light emitting source includes a single strip-shaped substrate 10 and a plurality of LED wafers 201 fixed on the strip-shaped substrate; the strip-shaped substrate 10 is a transparent strip-shaped substrate, and glue mixed with fluorescent powder is applied to two sides of the strip-shaped substrate 10. The two ends of the strip-shaped substrate 10 are conductive electrical connecting ends 30; the electrical connecting ends 30 can be directly connected with the AC power supply and energize the strip-shaped LED wafer set 20, so that the LED wafers 201 emit light.

Further, a plurality of LED wafers 201 are connected in turn and arranged on the strip-shaped substrate 10 at an interval to form a strip-shaped LED wafer set 20; a rectifying unit electrically connected with the strip-shaped LED wafer set 20 is arranged at each one of the two ends of the strip-shaped LED wafer set 20, and each one of the rectifying units is fixed on the strip-shaped substrate 10 and is connected with each corresponding one of the electrical connecting ends 30. Where, the strip-shaped LED wafer set 20 and the rectifying units are arranged on the same side of the strip-shaped substrate 10.

Further, the rectifying units includes a first rectifying unit 401 and a second rectifying unit 402 which are arranged on one side of the strip-shaped LED wafer set 20, and a third rectifying unit 403 and a fourth rectifying unit 404 which are arranged on the other side of the strip-shaped LED wafer set 20, and the four rectifying units and the strip-shaped LED wafer set 20 communicate with one another to form a rectifying circuit.

Further, a first conductor 101 and a second conductor 102 are arranged on two lateral sides of a face, on which the LED wafers 201 are fixed, of the strip-shaped substrate 10. The specific connection relationship is as follows: The LED wafers 201 in the strip-shaped LED wafer set 20 are connected toward the same direction; the first conductor 101 is connected with an output terminal of the first rectifying unit 401, an input terminal of the strip-shaped LED wafer set 20, and an output terminal of the fourth rectifying unit 404, and the second conductor 102 is connected with an input terminal of the second rectifying unit 402, an output terminal of the strip-shaped LED wafer set 20, and an input terminal of the third rectifying unit 403.

Further, the first rectifying unit 401 and the second rectifying unit 402 are oppositely arranged; the third rectifying unit 403 and the fourth rectifying unit 404 are oppositely arranged; and each one of the rectifying units includes at least one rectifying diode 50, and the rectifying diode 50 may be a high-voltage-withstanding silicon rectifying diode. The high-voltage-withstanding silicon rectifying diode is low in cost, and high in durability, and can be pasted on the strip-shaped substrate by the traditional process, so the production and processing are convenient.

Figure 2:
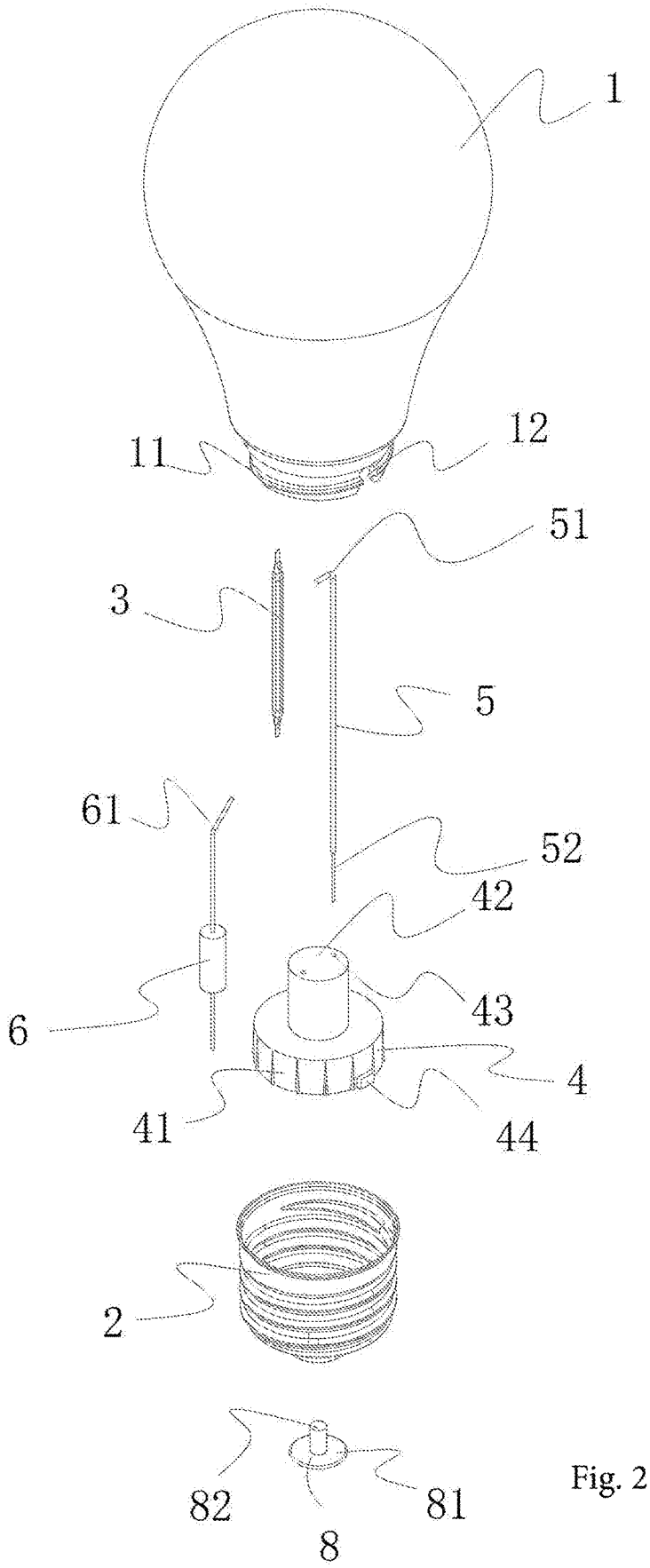
FIG. 2 is an exploded view of embodiment 2 of the LED filament lamp of the present invention.

Embodiment 2 As shown in FIG. 2, an LED filament lamp includes a transparent hood 1 with an opening at the lower end, and a lamp cap 2 connected to the lower end of the transparent hood 1; the transparent hood 1 is made of a plastic material; the transparent hood 1 is provided with external screw threads 11 at the opening of the lower end; the lamp cap 2 is provided with internal screw threads; and the transparent hood 1 and the lamp cap 2 are in a threaded connection. Where, a groove 12 is formed at the external screw threads 11 of the transparent hood 1.

A light emitting source 3 is arranged in the transparent hood 1; a support base 4 is arranged in a space enclosed by the transparent hood 1 and the lamp cap 2; one end of the light emitting source 3 is connected with the support base 4 through a support member 5; the other end of the light emitting source 3 is connected with the lamp cap 2 through a current limiting resistor 6, and the lower end of the support member 5 extends out of the support base 4 and is connected with the lamp cap 2.

When a bulb is working and under the condition that the lamp cap 2 is connected with an external grid circuit, the lamp cap 2, the current limiting resistor 6, the light emitting source 3 and the support member 5 form a current path to energize the light emitting source 3, so that the light emitting source emits light.

Further, the support base 4 includes a seat 41 and a fixed boss 42 arranged on the seat 41; the fixed boss 42 is formed with a fixing hole 43 which runs through the seat 41; a clamping block 44 is arranged on an outside wall of the lower end of the seat 41; and the clamping block 44 is clamped and fixed with the groove 12 of the transparent hood 1.

In this embodiment, the transparent hood 1 is internally provided with one light emitting source 3. In such circumstances, the support member 5 is a long conductive wire; a bent portion 51 is arranged at the upper end of the conductive wire; and the bent portion 51 is welded with the upper end of the light emitting source 3. A connecting portion 52 with a relatively small diameter is arranged at the lower end of the support member 5; after the connecting portion 52 passes through the fixing hole 43 of the support base 4, the excessive part is coiled and fixed at a rod which is arranged below the support base 4 and on a lateral side of the fixing hole 43.

Further, the upper end of the current limiting resistor 6 is welded with the lower end of the light emitting source 3 through a third metal wire 61 which passes through the fixing hole 43, and the third metal wire 61 is provided with a bend 62 at a position close to the light emitting source 3.

Further, the lower end of the current limiting resistor 6 is connected with the lamp cap 2 through a lamp cap fixture 8, and the lamp cap fixture 8 includes a round seat 81 and an support pillar 82 arranged on the round seat.

Figure 5:
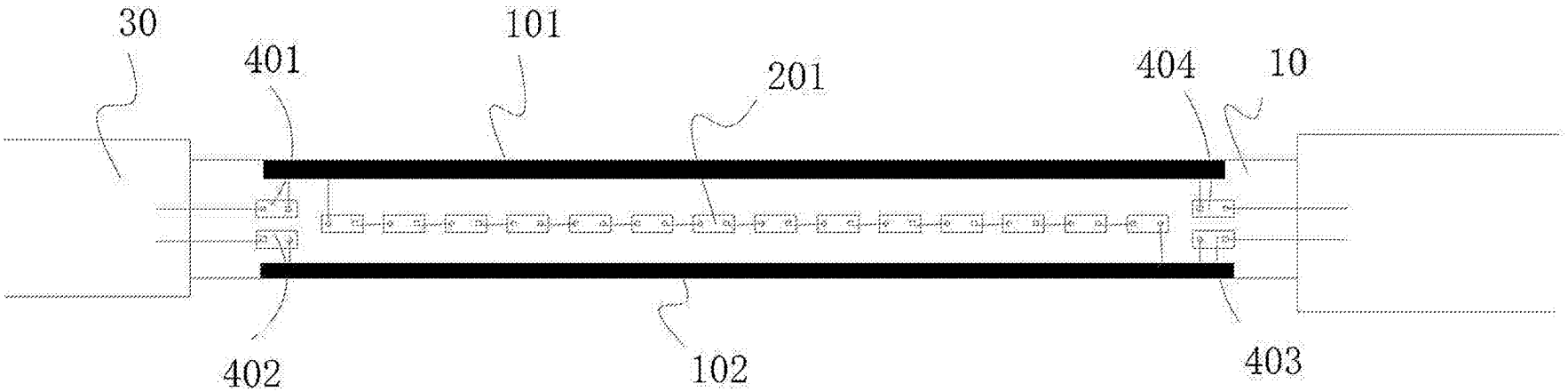
FIG. 5 is a structural view of a light emitting source in embodiment 2 of the LED filament lamp of the present invention.

As shown in FIG. 5 and FIG. 6, an LED light emitting source includes a single strip-shaped substrate 10 and a plurality of LED wafers 201 fixed on the strip-shaped substrate; the strip-shaped substrate 10 is a non-transparent strip-shaped substrate, and glue mixed with fluorescent powder is applied to two sides of the strip-shaped substrate 10. The two ends of the strip-shaped substrate 10 are conductive electrical connecting ends 30; the electrical connecting ends 30 can be directly connected with the AC power supply and energize the strip-shaped LED wafer set 20, so that the LED wafers 201 emit light.

Further, a plurality of LED wafers 201 are connected in turn and arranged on the strip-shaped substrate 10 at an interval to form a strip-shaped LED wafer set 20; a rectifying unit electrically connected with the strip-shaped LED wafer set 20 is arranged at each one of the two ends of the strip-shaped LED wafer set 20, and each one of the rectifying units is fixed on the strip-shaped substrate 10 and is connected with each corresponding one of the electrical connecting ends 30. Where, the strip-shaped LED wafer set 20 and the rectifying units are arranged on the same side of the strip-shaped substrate 10.

Further, the rectifying units include a first rectifying unit 401 and a second rectifying unit 402 which are arranged on one side of the strip-shaped LED wafer set 20, and a third rectifying unit 403 and a fourth rectifying unit 404 which are arranged on the other side of the strip-shaped LED wafer set 20, and the four rectifying units and the strip-shaped LED wafer set 20 communicate with one another to form a rectifying circuit.

Further, a first conductor 101 and a second conductor 102 are arranged on two lateral sides of a face, on which the LED wafers 201 are fixed, of the strip-shaped substrate 10. The specific connection relationship is as follows: The LED wafers 201 in the strip-shaped LED wafer set 20 are connected toward the same direction; the first conductor 101 is connected with an output terminal of the first rectifying unit 401, an input terminal of the strip-shaped LED wafer set 20, and an output terminal of the fourth rectifying unit 404, and the second conductor 102 is connected with an input terminal of the second rectifying unit 402, an output terminal of the strip-shaped LED wafer set 20, and an input terminal of the third rectifying unit 403.

Further, the first rectifying unit 401 and the second rectifying unit 402 are oppositely arranged; the third rectifying unit 403 and the fourth rectifying unit 404 are oppositely arranged; and each one of the rectifying units includes at least one LED wafer 201. When the rectifying units are configured using the LED wafer 201, the production process can be reduced. The existing LED wafers 201 can be arranged according to the circuit, and then the two ends of the strip-shaped substrate can be directly connected with the AC power supply. The operation is simple and convenient.

Figure 3:
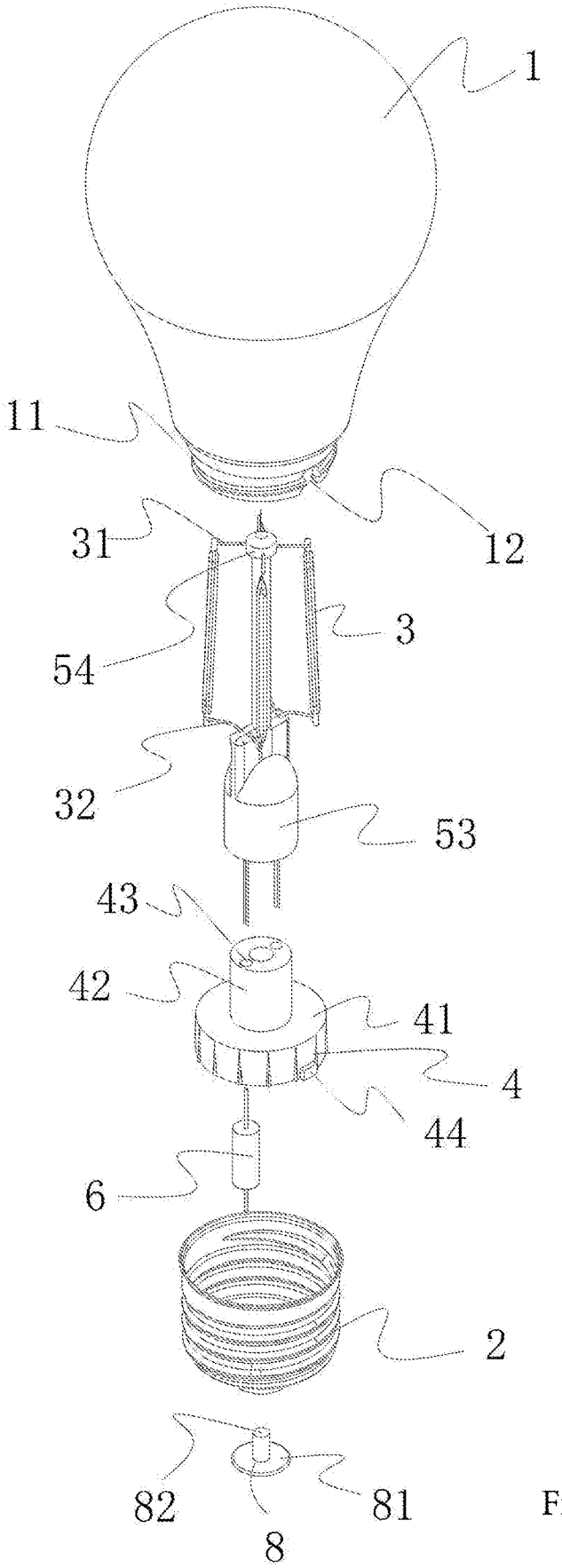
FIG. 3 is an exploded view of embodiment 3 of the LED filament lamp of the present invention.

Embodiment 3 As shown in FIG. 3, an LED filament lamp includes a transparent hood 1 with an opening at the lower end, and a lamp cap 2 connected to the lower end of the transparent hood 1; the transparent hood 1 is made of a plastic material; the transparent hood 1 is provided with external screw threads 11 at the opening of the lower end; the lamp cap 2 is provided with internal screw threads; and the transparent hood 1 and the lamp cap 2 are in a threaded connection. Where, a groove 12 is formed at the external screw threads 11 of the transparent hood 1.

A light emitting source 3 is arranged in the transparent hood 1; a support base 4 is arranged in a space enclosed by the transparent hood 1 and the lamp cap 2; one end of the light emitting source 3 is connected with the support base 4 through a support member 5; the other end of the light emitting source 3 is connected with the lamp cap 2 through a current limiting resistor 6, and the lower end of the support member 5 extends out of the support base 4 and is connected with the lamp cap 2.

When a bulb is working and under the condition that the lamp cap 2 is connected with an external grid circuit, the lamp cap 2, the current limiting resistor 6, the light emitting source 3 and the support member 5 form a current path to energize the light emitting source 3, so that the light emitting source emits light.

Further, the support base 4 includes a seat 41 and a fixed boss 42 arranged on the seat 41; the fixed boss 42 is formed with a fixing hole 43 which runs through the seat 41; a clamping block 44 is arranged on an outside wall of the lower end of the seat 41; and the clamping block 44 is clamped and fixed with the groove 12 of the transparent hood 1.

In this embodiment, the transparent hood 1 is internally provided with four light emitting sources 3. In such circumstances, the support member 5 is a support column; the support column includes a support stand 53 and support pillars 54 which are arranged on the support stand 53; the support stand 53 is formed with two through-holes; each one of the support pillars 54 is formed with a run-through positioning hole at the top end, and each one of the light emitting sources 3 is fixed at each corresponding one of the support pillars 54 through a metal wire.

Further, the top end of each one of the light emitting sources 3 is welded with a first metal wire 31; the bottom end of each one of the light emitting sources 3 is welded with a second metal wire 32; the number of the first metal wires 31 and the number of the second metal wires 32 are both four. Where, each one of the first metal wires 31 is inserted into each corresponding one of the positioning holes and all the first metal wires are converged and connected in the positioning holes; the second metal wires 32 pass through the through-holes of support stand 53 and then are inserted in and fixed in the fixing hole 43 of the support base 4. The lower end of each one of two second metal wires 32 is connected with the lamp cap 2, and the lower end of each one of the other two second metal wires 32 is connected with the current limiting resistor 6.

Further, the lower end of the current limiting resistor 6 is connected with the lamp cap 2 through a lamp cap fixture 8, and the lamp cap fixture 8 includes a round seat 81 and an support pillar 82 arranged on the round seat.

As shown in FIG. 4 and FIG. 6, an LED light emitting source includes a single strip-shaped substrate 10 and a plurality of LED wafers 201 fixed on the strip-shaped substrate; the strip-shaped substrate 10 is a transparent strip-shaped substrate, and glue mixed with fluorescent powder is applied to two sides of the strip-shaped substrate 10. The two ends of the strip-shaped substrate 10 are conductive electrical connecting ends 30; the electrical connecting ends 30 can be directly connected with the AC power supply and energize the strip-shaped LED wafer set 20, so that the LED wafers 201 emit light.

Further, a plurality of LED wafers 201 are connected in turn and arranged on the strip-shaped substrate 10 at an interval to form a strip-shaped LED wafer set 20; a rectifying unit electrically connected with the strip-shaped LED wafer set 20 is arranged at each one of the two ends of the strip-shaped LED wafer set 20, and each one of the rectifying units is fixed on the strip-shaped substrate 10 and is connected with each corresponding one of the electrical connecting ends 30. Where, the strip-shaped LED wafer set 20 and the rectifying units are arranged on the same side of the strip-shaped substrate 10.

Further, the rectifying units include a first rectifying unit 401 and a second rectifying unit 402 which are arranged on one side of the strip-shaped LED wafer set 20, and a third rectifying unit 403 and a fourth rectifying unit 404 which are arranged on the other side of the strip-shaped LED wafer set 20, and the four rectifying units and the strip-shaped LED wafer set 20 communicate with one another to form a rectifying circuit.

Further, a first conductor 101 and a second conductor 102 are arranged on two lateral sides of a face, on which the LED wafers 201 are fixed, of the strip-shaped substrate 10. The specific connection relationship is as follows: The LED wafers 201 in the strip-shaped LED wafer set 20 are connected toward the same direction; the first conductor 101 is connected with an output terminal of the first rectifying unit 401, an input terminal of the strip-shaped LED wafer set 20, and an output terminal of the fourth rectifying unit 404, and the second conductor 102 is connected with an input terminal of the second rectifying unit 402, an output terminal of the strip-shaped LED wafer set 20, and an input terminal of the third rectifying unit 403.

Further, the first rectifying unit 401 and the second rectifying unit 402 are oppositely arranged; the third rectifying unit 403 and the fourth rectifying unit 404 are oppositely arranged; each one of the rectifying units includes at least one rectifying diode 50, and the rectifying diode 50 may be a high-voltage-withstanding silicon rectifying diode. The high-voltage-withstanding silicon rectifying diode is low in cost, and high in durability, and can be pasted on the strip-shaped substrate by the traditional process, so the production and processing are convenient.

The present invention is illustrated and described with reference to preferred embodiments. However, those skilled in the art shall know that various changes in form and details can be made with the scope of the claims.

What is claimed is:

1. An LED filament lamp, comprising a transparent hood with an opening at a lower end;

a lamp cap connected to the lower end of the transparent hood;

a light emitting source arranged in the transparent hood;

a support base arranged in a space enclosed by the transparent hood and the lamp cap, wherein the light emitting source is fixed at the support base, a lower end of the light emitting source is connected with the lamp cap through a current limiting resistor, and the light emitting source comprises:

a single strip-shaped substrate, two ends of the strip-shaped substrate being conductive electrical connecting ends; and a plurality of LED wafers, wherein the plurality of LED wafers are connected in turn and arranged on the strip-shaped substrate at an interval to form a strip-shaped LED wafer set, a rectifying unit electrically connected with the strip-shaped LED wafer set is arranged at each one of the two ends of the strip-shaped LED wafer set, each one of the rectifying units is fixed on the strip-shaped substrate and is connected with each corresponding one of the electrical connecting ends, each one of the electrical connecting ends is capable of being directly connected with an alternating current and energizes the strip-shaped LED wafer set to lighten the LED wafers, wherein the rectifying units include a first rectifying unit and a second rectifying unit which are arranged on one side of the strip-shaped LED wafer set, and a third rectifying unit and a fourth rectifying unit which are arranged on the other side of the strip-shaped LED wafer set, the four rectifying units and the strip-shaped LED wafer set a communicate with one another to form a rectifying circuit wherein a first conductor and a second conductor are respectively arranged on two lateral sides of the face, on which the LED wafers are fixed, of the strip-shaped substrate, the first conductor is connected with an output terminal of the first rectifying unit, an input terminal of the strip-shaped LED wafer set, and an output terminal of the fourth rectifying unit, and the second conductor is connected with an input terminal of the second rectifying unit, an output terminal of the strip-shaped LED wafer set, and an input terminal of the third rectifying unit, wherein the first rectifying unit and the second rectifying unit are oppositely arranged, the third rectifying unit and the fourth rectifying unit are oppositely arranged, each one of the rectifying units comprises at least one LED wafer and when each one of the rectifying units is internally provided with a plurality of LED wafers, the LED wafers in each one of the rectifying units are arranged toward the same direction, wherein the strip-shaped LED wafer set and the rectifying units all are arranged on the same side of the strip-shaped substrate; the LED wafers in the strip-shaped LED wafer set are connected toward the same direction, wherein the strip-shaped substrate is a transparent or non-transparent strip-shaped substrate, and glue mixed with fluorescent powder is applied to the two sides of the strip-shaped substrate, and wherein when the lamp cap is connected with an external circuit, a current path is formed between the lamp cap, the current limiting resistor, and the light emitting source to energize the light emitting source, so that the light emitting source emits light.

2. The LED filament lamp according to claim 1, wherein the transparent hood is made of glass, the transparent hood and the lamp cap are fixed using adhesive, and wherein the support base comprises a seat and a fixed boss arranged on the seat, the fixed boss is provided with fixing holes which runs through the seat, a lower end of the seat is provided with external screw threads, the lamp cap is provided with internal screw threads, and the seat and the lamp cap are in a threaded connection.

3. The LED filament lamp according to claim 2, wherein an upper end of the light emitting source is connected with the support base through a support member, while a lower end of the support member extends out of the support base and is connected with the lamp cap, wherein when one light emitting source is provided, the support member is a long conductive wire, the conductive wire has a bent portion at an upper end, and the bent portion is welded with the upper end of the light emitting source, wherein a connecting portion (52) with a relatively small diameter is arranged at a lower end of the conductive wire; the connecting portion passes through the fixing holes of the support base and is connected with the support base in a through-hole fastening way, and wherein an upper end of the current limiting resistor is welded with the lower end of the light emitting source through a third metal wire which passes through the fixing hole of the support base, and the third metal wire is provided with a bend at a position close to the light emitting source.

4. The LED filament lamp according to claim 2, wherein an upper end of the light emitting source is connected with the support base through a support member, a lower end of the support member extends out of the support base and is connected with the lamp cap, wherein when more than one light emitting source is provided, the support member is a support column, wherein the support column comprises a support stand and support pillars arranged on the support stand, and wherein the support stand is provided with two through-holes, and a run-through positioning hole is formed on a top end of each one of the support pillars; the light emitting sources are fixed on the support column through metal wires.

5. The LED filament lamp according to claim 4, wherein each one of the individual light emitting sources is welded with a first metal wire at a top end and a second metal wire at a bottom end; each one of the first metal wires is inserted in and fixed at each corresponding one of the positioning holes and all first metal wires are converged and connected in the positioning holes; the second metal wires pass through the through-hole of the support stand and then are inserted into and fixed at the fixing holes of the support base; a lower end of at least one of the second metal wires is connected with the lamp cap and a lower end of at least one of the second metal wires is connected with the current limiting resistor.

6. The LED filament lamp according to claim 1, wherein the transparent hood is made of a plastic material, the transparent hood is provided with external screw threads at the opening of the lower end, the lamp cap is provided with internal screw threads, the transparent hood and the lamp cap are in a threaded connection; a groove is formed at the position of the external screw threads of the transparent hood; and wherein the support base comprises a seat and a fixed boss which is arranged on the seat, the fixed boss is provided with fixing holes which runs through the seat, a clamping block is arranged on an outside wall of the lower end of the seat, and the clamping block is clamped and fixed with the groove of the transparent hood.

7. The LED filament lamp according to claim 6, wherein an upper end of the light emitting source is connected with the support base through a support member, while a lower end of the support member extends out of the support base and is connected with the lamp cap, wherein when one light emitting source is provided, the support member is a long conductive wire, the conductive wire has a bent portion at an upper end, and the bent portion is welded with the upper end of the light emitting source, wherein a connecting portion with a relatively small diameter is arranged at a lower end of the conductive wire, the connecting portion passes through the fixing hole of the support base and is connected with the support base in a through-hole fastening way, and wherein an upper end of the current limiting resistor is welded with the lower end of the light emitting source through a third metal wire which passes through the fixing hole of the support base, and the third metal wire is provided with a bend at a position close to the light emitting source.

8. The LED filament lamp according to claim 6, wherein an upper end of the light emitting source (3) is connected with the support base (4) through a support member, a lower end of the support member extends out of the support base (4) and is connected with the lamp cap, wherein when more than one light emitting source (3) is provided, the support member is a support column; wherein the support column comprises a support stand and support pillars arranged on the support stand, and wherein the support stand is formed provided with two through-holes, and a run-through positioning hole is formed on a top end of each one of the support pillars, and; the light emitting sources are fixed on the support column through metal wires.

9. The LED filament lamp according to claim 8, wherein each one of the individual light emitting sources is welded with a first metal wire at a top end and a second metal wire at a bottom end; each one of the first metal wires is inserted in and fixed at each corresponding one of the positioning holes and all first metal wires are converged and connected in the positioning holes; the second metal wires pass through the through-hole of the support stand and then are inserted into and fixed at the fixing holes of the support base; a lower end of at least one of the second metal wires is connected with the lamp cap and a lower end of at least one of the second metal wires is connected with the current limiting resistor.

10. The LED filament lamp according to claim 1, wherein the lower end of the current limiting resistor is connected with the lamp cap through a lamp cap fixture, and the lamp cap fixture includes a round seat and an support pillar arranged on the round seat.

* * * * *